US008378274B2

(12) United States Patent
Fujinami et al.

(10) Patent No.: US 8,378,274 B2
(45) Date of Patent: Feb. 19, 2013

(54) INDUCTION HEATING DEVICE

(75) Inventors: Tomoya Fujinami, Hyogo (JP); Naoaki Ishimaru, Osaka (JP); Izuo Hirota, Hyogo (JP); Akira Kataoka, Hyogo (JP)

(73) Assignee: Panasonic Corporation, Osaka (JP)

( * ) Notice: Subject to any disclaimer, the term of this patent is extended or adjusted under 35 U.S.C. 154(b) by 184 days.

(21) Appl. No.: 12/520,263

(22) PCT Filed: Mar. 19, 2007

(86) PCT No.: PCT/JP2007/055536

§ 371 (c)(1),
(2), (4) Date: Jun. 19, 2009

(87) PCT Pub. No.: WO2008/087745

PCT Pub. Date: Jul. 24, 2008

(65) Prior Publication Data

US 2010/0102054 A1 Apr. 29, 2010

(30) Foreign Application Priority Data

Jan. 16, 2007 (JP) ..... 2007-006688

(51) Int. Cl.
*H05B 6/12* (2006.01)
*H05B 6/08* (2006.01)

(52) U.S. Cl. ..... 219/627; 219/620; 219/622; 219/667

(58) Field of Classification Search ..... 219/497, 219/620–627, 635, 600, 647, 663, 446.1, 219/448.11, 667; 99/DIG. 14
See application file for complete search history.

(56) References Cited

U.S. PATENT DOCUMENTS

| | | | | |
|---|---|---|---|---|
| 6,140,617 | A | 10/2000 | Berkcan et al. | |
| 2004/0245244 | A1 * | 12/2004 | Hirota et al. | 219/624 |
| 2009/0134149 | A1 | 5/2009 | Keishima | |
| 2010/0219181 | A1 | 9/2010 | Kusaka | |

FOREIGN PATENT DOCUMENTS

| | | | |
|---|---|---|---|
| EP | 1571888 | A2 | 9/2005 |
| EP | 1 942 704 | A1 | 7/2008 |
| EP | 1 983 804 | A1 | 10/2008 |
| JP | 3-289086 | A | 12/1991 |

(Continued)

OTHER PUBLICATIONS

International Search Report for PCT/JP2007/055536, Jun. 12, 2007.

(Continued)

*Primary Examiner* — Henry Yuen
*Assistant Examiner* — Hung D Nguyen
(74) *Attorney, Agent, or Firm* — RatnerPrestia

(57) ABSTRACT

An induction heating device includes a top plate, a thermo-sensitive device, a temperature detector, a coil, a controller, and a light-emitting section. The top plate places thereon a cooking utensil containing material to be cooked. The thermo-sensitive device changes its electrical characteristics with the temperature of the cooking utensil. The temperature detector detects the temperature of the cooking utensil based on the electrical characteristics of the thermo-sensitive device. The coil heats the cooking utensil. The controller controls the coil based on the temperature information of the temperature detector, thereby controlling an amount of the electric heating power to be supplied to the cooking utensil. The light-emitting section emits visible light to the area over the thermo-sensitive device. The light from the light-emitting section illuminates the area over the thermo-sensitive device through the top plate.

9 Claims, 4 Drawing Sheets

FOREIGN PATENT DOCUMENTS

| | | | | |
|---|---|---|---|---|
| JP | 2002075624 | A | * | 3/2002 |
| JP | 2004-047283 | A | * | 2/2004 |
| JP | 2004-95309 | A | | 3/2004 |
| JP | 2004095309 | A | | 3/2004 |
| JP | 2004-227839 | A | | 8/2004 |
| JP | 2004227838 | A | * | 8/2004 |
| JP | 2004227839 | A | | 8/2004 |
| JP | 2004327053 | A | * | 11/2004 |
| JP | 2004-355895 | A | | 12/2004 |
| JP | 2005-317305 | A | | 11/2005 |
| JP | 2005317305 | A | | 11/2005 |
| JP | 2006-294284 | A | | 10/2006 |
| JP | 2007-80701 | A | | 3/2007 |
| JP | 4793002 | B2 | | 8/2011 |
| JP | 4839786 | B2 | | 10/2011 |
| WO | WO 2007/055218 | A1 | | 5/2007 |
| WO | WO 2007/091440 | A1 | | 8/2007 |

OTHER PUBLICATIONS

Supplementary Partial European Search Report for Application No. EP 07717717 dated Aug. 6, 2012.

* cited by examiner

INDUCTION HEATING DEVICE

This application is a U.S. National Phase Application of PCT International Application PCT/JP2007/055536.

TECHNICAL FIELD

The present invention relates to an induction heating device used in households, offices, restaurants, and other places.

BACKGROUND ART

FIG. 4 is a schematic diagram of a conventional induction heating device. The heating device includes top plate 22, infrared sensor 23, temperature detector 24, heating coil 25, controller 26, and input section 27. On top plate 22, cooking utensil 21 is placed. Infrared sensor 23 is disposed to face a lateral side of cooking utensil 21. Temperature detector 24 converts the light energy received by infrared sensor 23 into temperature. Coil 25 is disposed under top plate 22. Controller 26 controls coil 25 to induce a high-frequency current so as to induction-heat cooking utensil 21. Input section 27 receives input from a user, which is sent to controller 26 as heating conditions.

When the user operates input section 27 to start to heat cooking utensil 21, coil 25 generates a high-frequency magnetic field in response to a signal from controller 26. This high-frequency magnetic field heats cooking utensil 21 to increase its temperature. Infrared sensor 23 detects the intensity of the infrared radiation from cooking utensil 21, and temperature detector 24 converts the output of infrared sensor 23 into temperature. Controller 26 controls the amount of heating based on the conversion result.

In this structure, infrared sensor 23 is disposed above top plate 22 in order to measure the temperature of the lateral side of cooking utensil 21. This, however, causes infrared sensor 23 to receive the infrared radiation from not only cooking utensil 21 but also other sources, decreasing the accuracy of the temperature measured by temperature detector 24.

Patent Document 1: Japanese Patent Unexamined Publication No. 2006-294284.

SUMMARY OF THE INVENTION

The present invention is an induction heating device which is made user-friendly by illuminating the area over a thermo-sensitive device through the top plate so as to show the correct position of the thermo-sensitive device on the top plate, and which has an infrared sensor detecting temperature with high accuracy.

The induction heating device of the present invention includes a top plate, a thermo-sensitive device, a temperature detector, a coil, a controller, and a light-emitting section. The top plate places thereon a cooking utensil containing material to be cooked. The thermo-sensitive device changes its electrical characteristics with the temperature of the cooking utensil. The temperature detector detects the temperature of the cooking utensil based on the electrical characteristics of the thermo-sensitive device. The coil heats the cooking utensil. The controller controls the coil based on the temperature information of the temperature detector, thereby controlling an amount of the electric heating power to be supplied to the cooking utensil. The light-emitting section emits visible light to the area over the thermo-sensitive device. The light from the light-emitting section illuminates the area over the thermo-sensitive device through the top plate. With this structure, the light-emitting section shows the correct position of the thermo-sensitive device on the top plate so as to make the heating device user-friendly, and the thermo-sensitive device detects temperature with high accuracy.

DETAILED DESCRIPTION OF PREFERRED EMBODIMENT

An embodiment of the present invention will be described as follows with reference to drawings. Note that the present invention is not limited to this embodiment.

Figure 1:
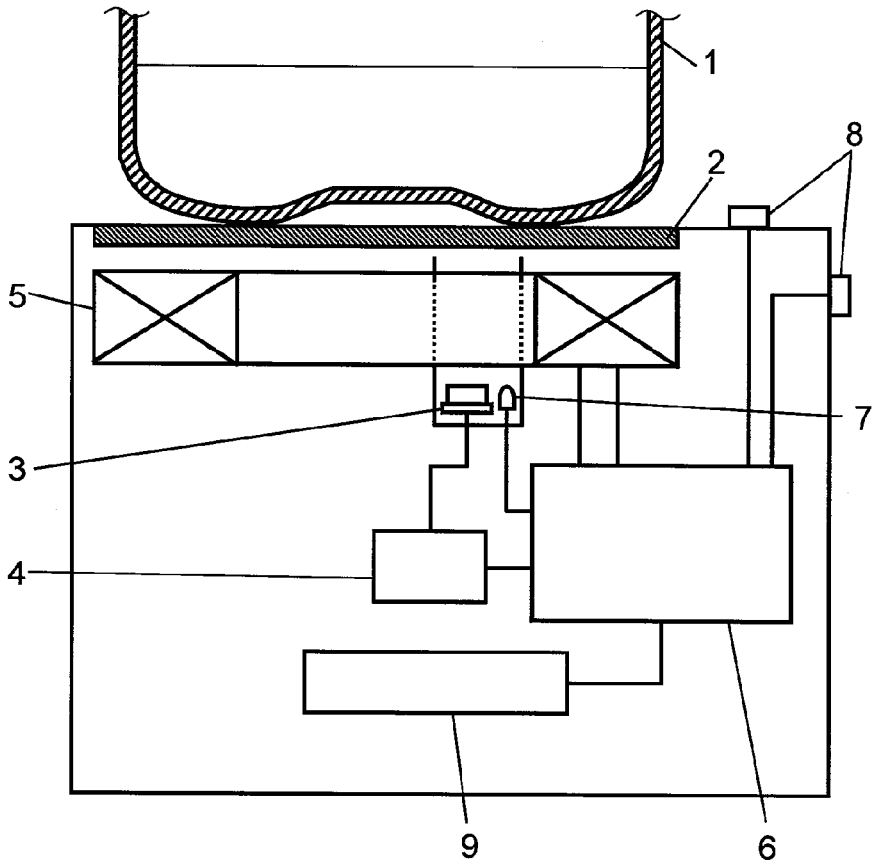
FIG. 1 is a schematic configuration view of an induction heating device according to an embodiment of the present invention.

FIG. 1 is a schematic configuration view of an induction heating device according to an embodiment of the present invention. The heating device includes top plate 2, infrared sensor 3, temperature detector 4, heating coil 5, controller 6, light-emitting section 7, and input sections 8.

Top plate 2 is a part of the outer shell of the device. On top plate 2, cooking utensil 1 is placed. Cooking utensil 1 contains material to be cooked. Top plate 2 is made, for example, of heat resistant tempered glass and formed flat, thus providing easy cleaning and fine appearance. At least the portion of top plate 2 that is just above infrared sensor 3 is light-transmissive.

Infrared sensor 3, which is a thermo-sensitive device for detecting the temperature of cooking utensil 1, receives and detects the infrared radiation from cooking utensil 1 through top plate 2. Infrared sensor 3 directly receives the infrared radiation from cooking utensil 1. This allows the heating device to respond quickly to temperature changes in cooking utensil 1 regardless of the size of the contact area between cooking utensil 1 and top plate 2 or the heat capacity of top plate 2.

Representative examples of infrared sensor 3 include photodiodes, phototransistors, thermopiles, pyroelectric elements, and porometers. It is also possible to use a thermo-sensitive device other than an infrared sensor as long as it changes its electrical characteristics with the temperature of cooking utensil 1. In addition, infrared sensor 3 may include a portion (element) for receiving infrared energy, and a portion (circuit) for amplifying the physical quantity obtained from the energy.

Temperature detector 4 detects the temperature of cooking utensil 1 based on the output of infrared sensor 3. More specifically, temperature detector 4 converts the output of infrared sensor 3 into temperature. Infrared sensor 3 converts the received energy into voltage, current, frequency, or the like and then outputs it, and temperature detector 4 converts the physical quantity into temperature. In other words, temperature detector 4 detects the temperature of cooking utensil 1 based on the electrical characteristics of the thermo-sensitive device. The calculated temperature is used as the information necessary to control an amount of the electric heating power. Thus, temperature detector 4 has functions of receiving a physical quantity of infrared sensor 3, converting the physical quantity into temperature, and outputting the converted temperature.

Coil 5, which is disposed under top plate 2, generates a high-frequency magnetic field and heats cooking utensil 1 by electromagnetic induction. Controller 6 controls coil 5 based on the temperature information from temperature detector 4 so as to control the electric heating power to be supplied to cooking utensil 1. More specifically, controller 6 controls the high-frequency current to be supplied to coil 5.

Light-emitting section 7, which is disposed under top plate 2, emits visible light to the area over infrared sensor 3. As a result, the area over infrared sensor 3 is illuminated by the light of light-emitting section 7 through top plate 2. Light-emitting section 7 is disposed near infrared sensor 3 in FIG. 1, but may be disposed in any other position as long as it can illuminate the vicinity of infrared sensor 3 or the field of view of infrared sensor 3 and its vicinity.

Input sections 8 receive input from a user. The input is sent to controller 6, which starts and stops heating, determines the heating output, selects the mode to automatically regulate the heating power for deep frying, water boiling or the like, sets the timer for automatically stopping heating, or performs other operations. Input sections 8 may be in the form of switches, speech recognizers, or others. Input sections 8 are provided on both the same surface as top plate 2 and the surface perpendicular thereto in FIG. 1; however, only one input section 8 can be provided on either surface.

The following is a description of operations and actions of the induction heating device thus structured. First, when the user turns on the power, controller 6 controls light-emitting section 7 to emit light so as to inform the user that the heating device is ready for use. In other words, the light from light-emitting section 7 illuminates the area over infrared sensor 3 through top plate 2, or the portion of top plate 2 that is just above infrared sensor 3, so that the user can visually recognize the position of infrared sensor 3. With this structure, light-emitting section 7 shows the correct position of infrared sensor 3 on top plate 2, and infrared sensor 3 is unsusceptible to external disturbing light because of being disposed inside the outer shell of top plate 2.

Thus, the user can recognize the position of infrared sensor 3 which is disposed under top plate 2 instead of forming a hole in top plate 2 in which to dispose infrared sensor 3. The absence of such a hole in top plate 2 prevents a decrease in its mechanical strength. Since the user can place cooking utensil 1 in the position of top plate 2 that is just above infrared sensor 3, temperature detector 4 can accurately detect the temperature of cooking utensil 1.

Thus, the light from light-emitting section 7 shows the correct position of infrared sensor 3 on top plate 2 by illuminating the portion of top plate 2 that is just above infrared sensor 3. This eliminates the need to show the position of infrared sensor 3 on top plate 2 by applying a seal or the like thereto. The absence of such a seal, which could gather dirt when applied, prevents top plate 2 from losing its aesthetic appearance.

After placing cooking utensil 1 in the position of top plate 2 that is just above infrared sensor 3, the user inputs an instruction to start heating through input sections 8 connected to controller 6. In response to this instruction, controller 6 supplies a high-frequency current to coil 5 connected thereto. Cooking utensil 1 is placed on top plate 2 over coil 5 and magnetically coupled with coil 5. Coil 5 thus supplied with the high-frequency current generates a high-frequency magnetic field so as to electromagnetically induce an eddy current to cooking utensil 1. As a result, cooking utensil 1 is heated by Joule heat.

Infrared sensor 3 receives the infrared radiation from cooking utensil 1 through top plate 2, and transmits the information to temperature detector 4. Temperature detector 4 calculates the temperature of cooking utensil 1 based on the energy amount that infrared sensor 3 has received, and transmits the temperature information to controller 6.

Controller 6 controls an amount of the electric heating power to be the value selected by the user, and may suppress the electric heating power or stop heating depending on the temperature information from temperature detector 4. For example, when heating is started in the mode for deep frying, controller 6 controls the electric heating power so that cooking utensil 1 is maintained at a predetermined temperature. When cooking utensil 1 reaches an abnormally high temperature during normal heating, controller 6 suppresses or stops the electric heating power so as to prevent oil from catching fire, thereby ensuring safety. Controller 6 and temperature detector 4 can be integrated. They are often composed of a digital signal processor (DSP) or a microcomputer, but may alternatively be composed of a custom IC.

Figure 4:
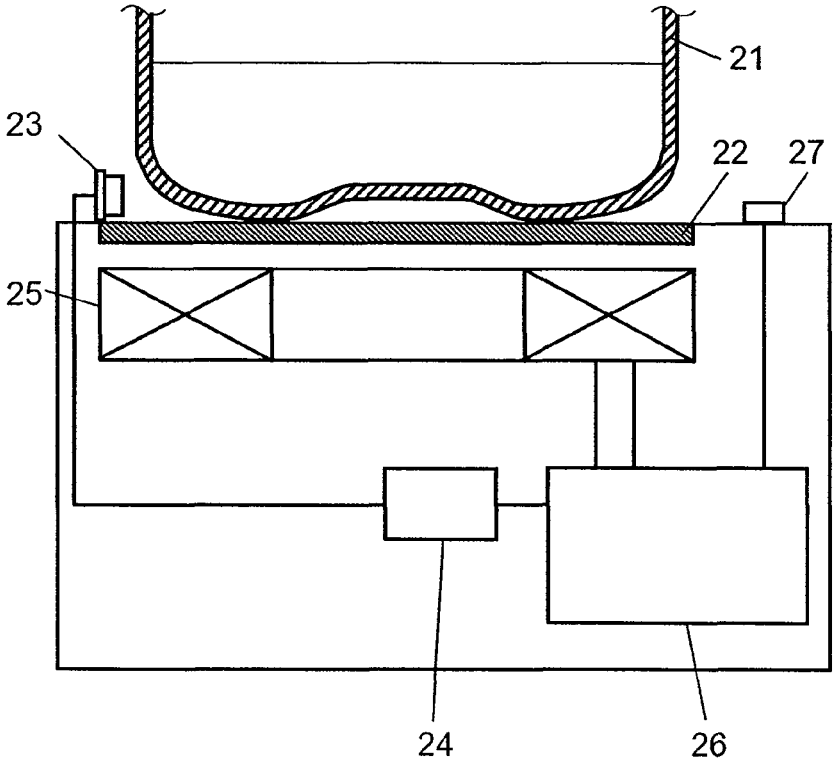
FIG. 4 PRIOR ART
FIG. 4 is a schematic configuration view of a conventional induction heating device.

As described above, in the present embodiment, light-emitting section 7 emits visible light to the vicinity of infrared sensor 3 so as to illuminate the portion of top plate 2 that is just above infrared sensor 3. Compared with the conventional example of FIG. 4 where infrared sensor 23 is disposed to face a lateral side of cooking utensil 21, infrared sensor 3 receives less infrared radiation from fluorescent lights, sunlight, or the like, thus detecting temperature with higher accuracy.

The position of infrared sensor 3 is indicated by light on top plate 2 so that the user can recognize the correct position to place cooking utensil 1.

When the user places cooking utensil 1 over the light from light-emitting section 7 so as to the user cannot see the light, temperature detector 4 can detect the temperature without being susceptible to the infrared radiation from other than cooking utensil 1. The disappearance of the light emitted from light-emitting section 7 can be thus recognized by the user, making the induction heating device more user-friendly.

Light-emitting section 7 has an emission wavelength within the transmission wavelength of top plate 2. As described above, top plate 2 is a part of the outer shell of the induction heating device, and cooking utensil 1 is placed on it. Top plate 2 is required to have a sufficient mechanical strength because it can be broken, for example, in the event that the user drops cooking utensil 1 thereon or during transportation of the heating device. Furthermore, when cooking utensil 1 is heated on top plate 2 first, and then a different low-temperature cooking utensil 1 is placed on top plate 2 that has been heated to a high temperature, top plate 2 is subjected to thermal impact. To avoid from being broken under such circumstances, top plate 2 is preferably made, for example, of heat resistant tempered glass, which is crystallized glass or the like.

Figure 2:
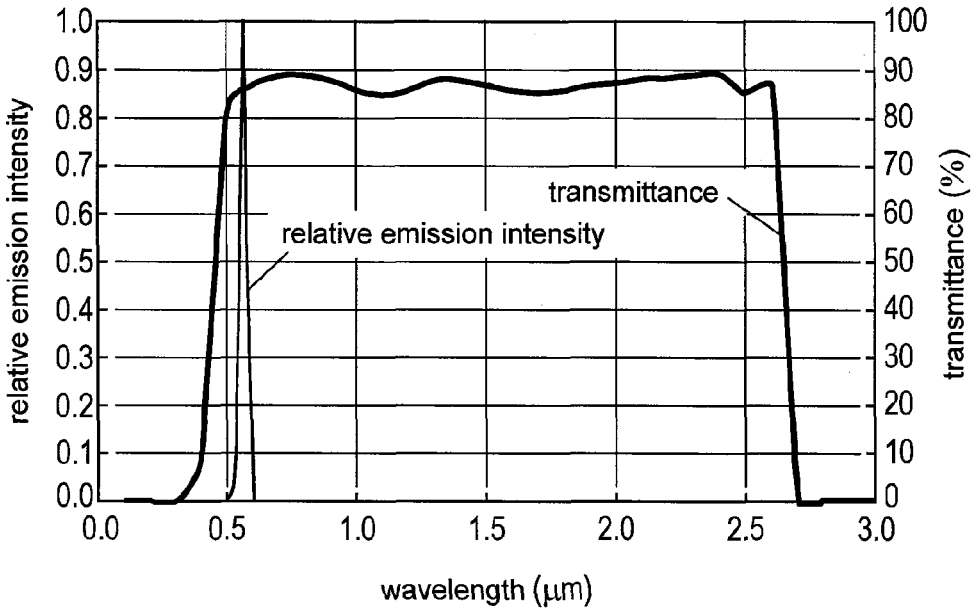
FIG. 2 shows the relation between transmittance of a top plate and relative emission intensity of a light-emitting diode.

FIG. 2 shows the relation between transmittance of top plate 2 and relative emission intensity of a light-emitting diode, which is an example of light-emitting section 7. Top plate 2 has a high transmittance of 80% or more in the wavelength range of 0.5 to 2.7 μm. Outside the range, on the other hand, the transmittance is extremely low. This indicates that controlling the emission wavelength of light-emitting section 7 to be within the transmission wavelength of top plate 2 makes the user visually recognize the light more easily through top plate 2.

Light-emitting section 7 preferably has a light-emitting diode as its light-emitting device. As described above, when the emission wavelength of light-emitting section 7 is outside the transmission wavelength range of top plate 2, the light from light-emitting section 7 is poorly visible to the user. When the emission wavelength of light-emitting section 7 is large, it overlaps the light sensitive region of infrared sensor 3. This causes infrared sensor 3 to receive the light from light-emitting section 7, thus decreasing the signal-to-noise (SN) ratio. Therefore, the emission wavelength of light-emitting section 7 is preferably narrow and is within the transmission wavelength range of top plate 2 so as to provide both high visibility and a high SN ratio of infrared sensor 3. Although light-emitting section 7 can be an electric bulb, a halogen lamp, a fluorescent light, or the like, light-emitting section 7 is thus preferably a light-emitting diode having a narrow emission wavelength.

A light-emitting diode has not only an emission wavelength range narrow enough to be away from the light sensitive region of infrared sensor 3, but also low power consumption, and hence, low heat generation due to a small loss. Since infrared sensor 3 increases its output and errors with increasing temperature, a light-emitting diode producing little heat is suitable as light-emitting section 7 disposed near infrared sensor 3.

Light-emitting section 7 is preferably made to emit light before heating is started so that the light serves as a mark indicating the field of view of infrared sensor 3 on top plate 2. When the user places cooking utensil 1 over the light, infrared sensor 3 can measure the temperature of cooking utensil 1. In other words, when the user does not place cooking utensil 1 exactly over the light, infrared sensor 3 cannot accurately measure the temperature of cooking utensil 1. Therefore, light-emitting section 7 is made to emit light before heating is started so as to prompt the user to place cooking utensil 1 exactly over the light, thereby allowing infrared sensor 3 to accurately measure the temperature.

To achieve this, controller 6 controls the timing at which light-emitting section 7 emits light. Alternatively, it is possible to provide a light emission controller for controlling light-emitting section 7 to emit light before heating is started, based on the input sent from input sections 8 to indicate the start of heating.

Light-emitting section 7 is preferably made to stop emitting light after heating is started. As described above, light-emitting section 7 emits light to provide the user with a mark to place cooking utensil 1. Since cooking utensil 1 is placed over the light, the user cannot visually recognize whether or not light-emitting section 7 is emitting light after placing cooking utensil 1.

Light-emitting section 7 is preferably made to stop emitting light after heating is started, because after heating is started, the user does not move cooking utensil 1 or cannot visually recognize the light. This can reduce power consumption, and hence, extend the life of light-emitting section 7.

To achieve this, controller 6 controls the timing at which light-emitting section 7 stops emitting light. Alternatively, it is possible to provide a light emission controller for controlling light-emitting section 7 to stop emitting light after heating is started, based on a signal sent from controller 6 to indicate that heating has been started.

As shown in FIG. 1, it is preferable to provide cooking utensil sensor 9 for detecting whether or not cooking utensil 1 is placed on top plate 2. It is preferable that light-emitting section 7 emits light when cooking utensil sensor 9 detects that cooking utensil 1 is not placed on top plate 2. Cooking utensil sensor 9 is connected to controller 6. Controller 6 does not supply electric power to coil 5 when cooking utensil sensor 9 detects that cooking utensil 1 is not placed on top plate 2.

This prevents damage of the heating device and unnecessary power consumption, which can be caused during heating without cooking utensil 1 on top plate 2. This also prevents cooking utensil 1 from being heated to an abnormally high temperature when cooking utensil 1 is heated under the condition that infrared sensor 3 cannot detect the temperature of cooking utensil 1 because it is not within the field of view of infrared sensor 3.

Cooking utensil sensor 9 can detect the presence or absence of cooking utensil 1 in various ways as follows. For example, a pickup coil and an oscillating circuit can be connected to each other to detect a change in magnetic coupling. It is also possible to connect an electrode and an oscillating circuit so as to detect a change in capacitance. It is also possible to examine whether light emitted from a light-emitting section reaches a light receiving section. Thus, the structure of cooking utensil sensor 9 is not particularly limited. Cooking utensil sensor 9 and controller 6 can be integrated. They are often composed of a DSP or a microcomputer, but may alternatively be composed of a custom IC.

When cooking utensil sensor 9 detects the absence of cooking utensil 1, light-emitting section 7 preferably emits light or flashes so as to prompt the user to place cooking utensil 1 in the correct position. With this structure, the induction heating device can be used safely.

It is possible to provide a light emission controller for controlling light-emitting section 7 to emit light when cooking utensil sensor 9 detects that cooking utensil 1 is not placed on top plate 2.

Light-emitting section 7 may include a component for switching between a plurality of emission wavelengths so as to have different emission wavelengths before and after heating is started. Alternatively, light-emitting section 7 may include a plurality of light-emitting diodes having different emission wavelengths from each other, and may switch between these diodes. For example, light-emitting section 7 can emit green light to indicate that the heating device is ready for use, and red light to indicate that the heating device is in use. This informs the user of the operating condition of the heating device, making the heating device more user-friendly.

To achieve this, controller 6 controls light-emitting section 7 to change the emission wavelength. Alternatively, it is possible to provide a light emission controller for controlling light-emitting section 7 to have different emission wavelengths between before and after heating is started, based on the signal sent from controller 6 to indicate that heating has been started.

Alternatively, light-emitting section 7 may change the emission wavelength between whether or not cooking utensil 1 is placed on top plate 2. In the same manner as above, light-emitting section 7 can change the emission wavelength as follows. For example, green light can be emitted to indicate that cooking utensil sensor 9 has detected cooking utensil 1 and the heating device is ready for use, and red light can be emitted to indicate that cooking utensil sensor 9 does not detect cooking utensil 1 and the heating device is cannot be used. This helps the user to know whether or not the heating device is ready for use to heat cooking utensil 1, making the heating device more user-friendly.

To achieve this, controller 6 controls light-emitting section 7 to change the emission wavelength. Alternatively, it is possible to provide a light emission controller for controlling light-emitting section 7 to change the emission wavelength based on the signal sent from cooking utensil sensor 9.

Figure 3:
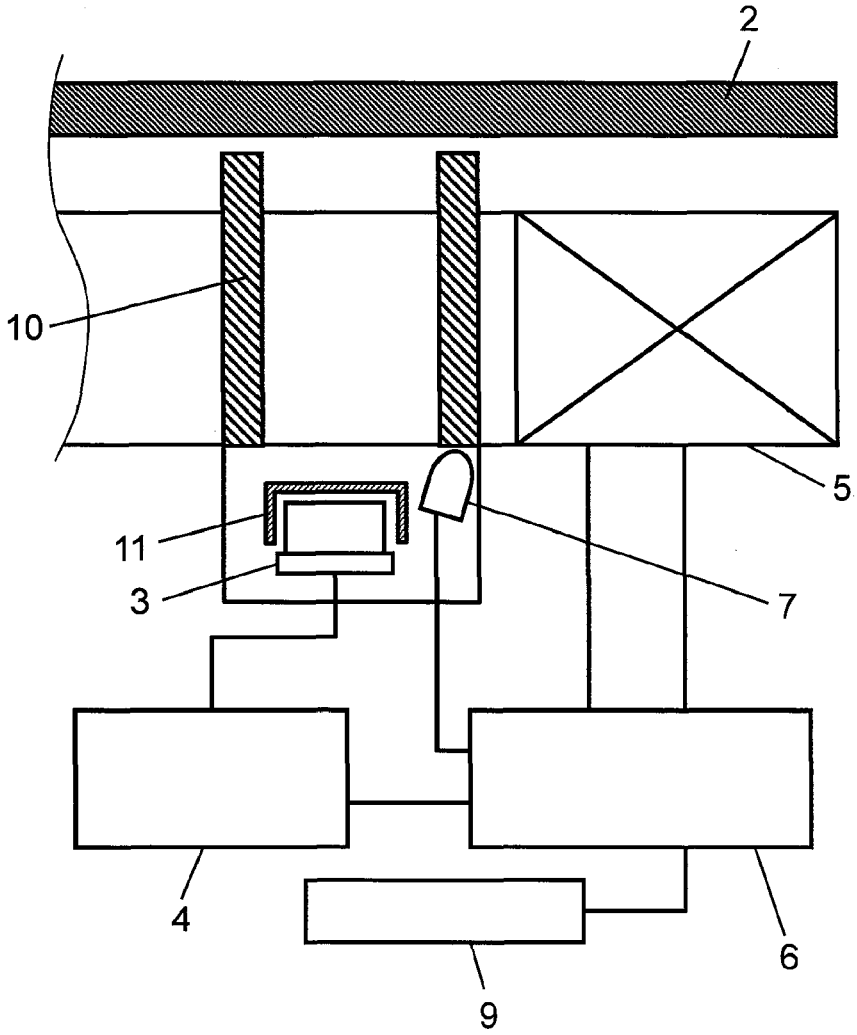
FIG. 3 shows an example of schematic configuration of a light-emitting section of the induction heating device according to the embodiment of the present invention.

In addition, as shown in the schematic configuration of FIG. 3, it is preferable to provide light guide section 10 for guiding the infrared radiation from cooking utensil 1 to infrared sensor 3. With this structure, infrared sensor 3 has a high SN ratio, and temperature detector 4 makes a small error in the calculation of temperature. In order to guide the infrared radiation from cooking utensil 1 to infrared sensor 3 efficiently, light guide section 10 preferably has a mirror-finished inner surface.

Light guide section 10 preferably has another function of guiding the light from light-emitting section 7 in the vicinity of top plate 2. More specifically, the light from light-emitting section 7 enters light guide section 10 through an end thereof and leaves through the other end. With this structure (arrangement), light guide section 10 can guide both the infrared radiation and the light from light-emitting section 7. Light guide section 10 guides the light in the vicinity of top plate 2, so that the user can see the light emitted through top plate 2 more clearly. Furthermore, light guide section 10 enables light-emitting section 7 to reduce its electric power and to eliminate restrictions on its arrangement, thereby increasing the design freedom of the heating device.

Light guide section 10 can be made of metal, resin, or optical fiber as long as it has a thermal conductivity low enough to prevent heat transfer from top plate 2 to infrared sensor 3.

It is also preferable to provide infrared-transmitting filter 11 which covers the field of view of infrared sensor 3 as shown in FIG. 3. Infrared-transmitting filter 11 cuts unwanted wavelengths when infrared sensor 3 receives infrared energy from cooking utensil 1. Removing sunlight and other noise components in this manner reduces the effect of the infrared radiation from other than cooking utensil 1, allowing temperature detector 4 to measure the temperature of cooking utensil 1 more accurately.

Infrared-transmitting filter 11 does not transmit the infrared energy having a wavelength equal to or less than the wavelength of the cut-off frequency and transmits the infrared energy having a wavelength more than the wavelength of the cut-off frequency. Infrared-transmitting filter 11 can be either a high-pass filter or a band-pass filter as long as it transmits the sensitivity wavelength region of infrared sensor 3.

Infrared-transmitting filter 11 is disposed near infrared sensor 3 as shown in FIG. 3, but a coating to function as infrared-transmitting filter 11 may alternatively be formed on the surface of top plate 2 so as to provide the same effect.

The emission wavelength of light-emitting section 7 is preferably equal to or less than the wavelength of the cut-off frequency of infrared-transmitting filter 11. When the light from light-emitting section 7 enters the field of view of infrared sensor 3, the energy becomes noise and reduces the SN ratio, thus making an error in the measurement of temperature. However, infrared-transmitting filter 11 blocks the light from light-emitting section 7 so as to eliminate the influence of the light on the energy that infrared sensor 3 receives. Therefore, infrared-transmitting filter 11 preferably has these characteristics. When infrared-transmitting filter 11 has a cut-off frequency having a wavelength higher than the emission wavelength of light-emitting section 7, infrared sensor 3 has a high SN ratio, improving the accuracy of temperature measurements.

The noise of infrared sensor 3 includes not only the light of light-emitting section 7 but also the visible light from the lights in the kitchen where the heating device is installed. Heating devices generally have a fail-safe to prevent oil from catching fire. Since the ignition temperature of oil is 330 to 350° C., oil can be prevented from catching fire by detecting the temperature of 300 to 330° C. and making controller 6 suppress or stop the heating output so as to prevent the oil temperature from exceeding the temperature range. The infrared energy from an object having a temperature of 300 to 330° C. includes an extremely small percent of wavelength components in the visible light region, and therefore, infrared sensor 3 rarely detects these wavelength components. In other words, infrared sensor 3 makes only a small error in the measurement of temperature although it cannot detect the wavelength components in the visible light region.

On the other hand, when receiving strong visible light, infrared sensor 3 makes errors in the measurement of temperature because the light cannot be distinguished from the infrared energy emitted from cooking utensil 1, which infrared sensor 3 is intended to receive. Therefore, in the case where it is only necessary to detect a temperature of 300 to 330° C., it has more merits than demerits to design infrared sensor 3 not to detect the visible light region.

From this viewpoint, it is preferable to dispose infrared-transmitting filter 11 so as to cover the field of view of infrared sensor 3, thereby cutting the visible light region. Infrared-transmitting filter 11 having such characteristics prevents infrared sensor 3 from receiving unwanted wavelengths and having an error in the measurement of temperature.

The light-receiving chip of infrared sensor 3 is available in a variety of materials, and silicon is most preferable among them as the chip material of infrared sensor 3 because of its inexpensiveness.

Infrared sensor 3 including silicon chip material has light sensitive wavelengths of 320 to 1100 nm. As described above, the heating device is required to have infrared sensor 3 which can detect a temperature of 300 to 330° C. as a function to prevent oil ignition. In order to detect this temperature range and to be produced at low cost, infrared sensor 3 preferably includes silicon chip material. It is also preferable to provide infrared-transmitting filter 11 because silicon includes the visible light region as its sensitivity wavelength region. Infrared-transmitting filter 11 reduces the influence of visible light noise so as to improve the SN ratio of infrared sensor 3, thereby reducing temperature measurement error. As a result, the heating device can follow and detect the temperature variation of cooking utensil 1 so as to provide both automatic cooking feature and safety feature based on the detected temperature. This makes the heating device more user-friendly.

Light-emitting section 7 illuminates the vicinity of infrared sensor 3 in the embodiment, but preferably illuminates the area over infrared sensor 3. The light from light-emitting section 7 illuminates the portion of top plate 2 that is just above infrared sensor 3 in the embodiment, but only has to illuminate the area over infrared sensor 3.

INDUSTRIAL APPLICABILITY

In the induction heating device of the present invention, the light from the light-emitting section illuminates the area over the thermo-sensitive device through the top plate, providing the user with a mark to place a cooking utensil. This specifies the position to place the cooking utensil, thereby reducing the effect of external disturbing light and also shows the correct position of the thermo-sensitive device on the top plate. This structure can also be applied to the case using a thermo-sensitive device other than an infrared sensor.

The invention claimed is:

1. An induction heating device comprising:

a top plate capable of placing thereon a cooking utensil containing material to be cooked, the top plate formed from translucent material;

an infrared sensor having a field of view in which the infrared sensor is capable of detecting infrared radiation, the infrared radiation being emitted from the cooking utensil and then transmitted through the top plate;

a temperature detector configured to detect a temperature of the cooking utensil based on an output of the infrared sensor;

a coil disposed under the top plate, the coil being configured to heat the cooking utensil;

a light-emitting section disposed under the top plate, the light-emitting section operable to emit visible light in an area at least partially overlapping with the field of view of the infrared sensor; and a controller configured to control the coil based on temperature information of the temperature detector, thereby control electric heating power to be supplied to the cooking utensil, and also control the light-emitting section, wherein the translucent material of the top plate and a wavelength and intensity of the visible light emitted by the light-emitting section are selected such that the visible light emitted by the light-emitting section is visible on an upper surface of the top plate within the area overlapping with the field of view of the infrared sensor.

2. The induction heating device according to claim 1, further comprising:

an infrared-transmitting filter disposed under the top plate so as to cover the field of view of the infrared sensor, thereby cutting a visible light region and transmitting infrared radiation of the infrared sensor in a sensitivity wavelength region, wherein the infrared sensor includes silicon chip material;

the controller makes the infrared sensor to detect a temperature of the cooking utensil, and suppresses or stops the electric heating power so as to prevent the temperature of the cooking utensil from exceeding an ignition temperature of oil; and the light-emitting section is a light-emitting diode having a light-emitting frequency of not more than a cut-off frequency of the filter and disposed near the infrared sensor.

3. The induction heating device according to claim 1, wherein the controller controls the light-emitting section to stop emitting light after heating is started.

4. An induction heating device comprising:

a top plate capable of placing thereon a cooking utensil containing material to be cooked, the top plate formed from translucent material;

an infrared sensor having a field of view in which the infrared sensor is capable of detecting infrared radiation, the infrared radiation being emitted from the cooking utensil and then transmitted through the top plate;

a temperature detector configured to detect a temperature of the cooking utensil based on an output of the infrared sensor;

a coil disposed under the top plate, the coil being configured to heat the cooking utensil;

a controller configured to control the coil based on temperature information of the temperature detector, thereby control electric heating power to be supplied to the cooking utensil, a light-emitting section disposed under the top plate, the light-emitting section operable to emit visible light in an area at least partially overlapping with the field of view of the infrared sensor; and a light guide section configured to guide the light from the light-emitting section, wherein translucent material of the top plate and a wavelength and intensity of the visible light emitted by the light-emitting section are selected such that the visible light emitted by the light-emitting section is visible on an upper surface of the top plate within the area overlapping with the field of view of the infrared sensor.

5. The induction heating device according to claim 4, wherein the light guide section guides the infrared radiation from the cooking utensil to the infrared sensor.

6. An induction heating device comprising:

a top plate capable of placing thereon a cooking utensil containing material to be cooked, the top plate formed from translucent material;

a thermo-sensitive device changing electrical characteristics thereof with a temperature of the cooking utensil;

a temperature detector configured to detect the temperature of the cooking utensil based on the electrical characteristics of the thermo-sensitive device;

a coil disposed under the top plate, the coil configured to heat the cooking utensil;

a light-emitting section disposed under the top plate, the light-emitting section operable to emit visible light in an area at least partially overlapping with the field of view of the infrared sensor; and a controller configured to control the coil based on temperature information of the temperature detector, thereby control electric heating power to be supplied to the cooking utensil, and also control the light-emitting section, wherein the translucent material of the top plate and a wavelength and intensity of the visible light emitted by the light-emitting section are selected such that the visible light emitted by the light-emitting section is visible on an upper surface of the top plate at a position directly above the thermo-sensitive device, and the controller controls the light-emitting section to stop emitting light after heating is started.

7. The induction heating device according to claim 6 wherein the thermo-sensitive device is an infrared sensor capable of detecting infrared radiation emitted from the cooking utensil and transmitted through the top plate; and the light from the light-emitting section illuminates a vicinity of a field of view of the infrared sensor instead of illuminating the vicinity of the thermo-sensitive device.

8. Induction heating device comprising:

a top plate capable of placing thereon a cooking utensil containing material to be cooked, the top plate formed from translucent material;

a thermo-sensitive device changing electrical characteristics thereof with a temperature of the cooking utensil;

a temperature detector configured to detect the temperature of the cooking utensil based on the electrical characteristics of the thermo-sensitive device;

a coil disposed under the top plate, the coil configured to heat the cooking utensil;

a light-emitting section disposed under the top plate, the light-emitting section operable to emit visible light in an area at least partially overlapping with the field of view of the infrared sensor;

a controller configured to control the coil based on temperature information of the temperature detector, thereby control electric heating power to be supplied to the cooking utensil, and also control the light-emitting section; and a cooking utensil sensor configured to detect whether or not the cooking utensil is placed on the top plate, wherein when the cooking utensil sensor detects that the cooking utensil is not placed on the top plate, the controller controls the light-emitting section to emit the visible light, and the translucent material of the top plate and a wavelength and intensity of the visible light emitted by the light-emitting section are selected such that the visible light emitted by the light-emitting section is visible on an upper surface of the top plate at a position directly above the thermo-sensitive device.

9. The induction heating device according to claim 8 wherein the thermo-sensitive device is an infrared sensor capable of detecting infrared radiation emitted from the cooking utensil and transmitted through the top plate; and the light from the light-emitting section illuminates a vicinity of a field of view of the infrared sensor instead of illuminating the vicinity of the thermo-sensitive device.

* * * * *

UNITED STATES PATENT AND TRADEMARK OFFICE

CERTIFICATE OF CORRECTION

PATENT NO. : 8,378,274 B2
APPLICATION NO. : 12/520263
DATED : February 19, 2013
INVENTOR(S) : Tomoya Fujinami et al.

It is certified that error appears in the above-identified patent and that said Letters Patent is hereby corrected as shown below:

In the Claims:

Column 10

At line 7, before "translucent", insert -- the --.

Signed and Sealed this
Ninth Day of July, 2013

Teresa Stanek Rea

Teresa Stanek Rea
*Acting Director of the United States Patent and Trademark Office*